US006087988A

United States Patent [19]

Pozgay

[11] Patent Number: 6,087,988

[45] **Date of Patent: *Jul. 11, 2000**

[54] IN-LINE CP PATCH RADIATOR

[75] Inventor: Jerome H. Pozgay, Medford, Mass.

[73] Assignee: Raytheon Company, Lexington, Mass.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/561,512

[22] Filed: Nov. 21, 1995

[51] Int. Cl.[7] ..... H01Q 1/38

[52] U.S. Cl. ..... 343/700 MS; 343/754

[58] Field of Search ..... 343/700 MS, 702, 343/753, 754, 909, 853, 829, 846; H01Q 1/38

[56] References Cited

U.S. PATENT DOCUMENTS

| | | | |
|---|---|---|---|
| 3,761,936 | 9/1973 | Archer et al. | 343/754 |
| 4,063,245 | 12/1977 | James et al. | 343/700 MS |
| 4,071,846 | 1/1978 | Oltman | 343/700 |
| 4,072,951 | 2/1978 | Kaloi | 343/700 |
| 4,151,532 | 4/1979 | Kaloi | 343/700 |
| 4,180,817 | 12/1979 | Sanford | 343/700 |
| 4,203,116 | 5/1980 | Lewin | 343/700 MS |
| 4,398,199 | 8/1983 | Makimoto et al. | 343/700 MS |
| 4,686,535 | 8/1987 | Lalezari | 343/700 |
| 4,907,006 | 3/1990 | Nishikawa et al. | 343/700 |
| 5,349,364 | 9/1994 | Bayanos et al. | 343/853 |
| 5,563,613 | 10/1996 | Schroeder et al. | 343/700 |
| 5,675,345 | 10/1997 | Pozgay et al. | 343/700 |

FOREIGN PATENT DOCUMENTS

| | | | |
|---|---|---|---|
| 0181706 | 10/1984 | Japan | 343/700 MS |
| 2091944 | 8/1982 | United Kingdom | 343/700 MS |

*Primary Examiner*—Don Wong
*Assistant Examiner*—Tho Phan
*Attorney, Agent, or Firm*—Fish & Richardson P.C.

[57] ABSTRACT

An antenna element is disclosed with a microstrip transmission line having a series of conductive patch radiating elements, each one of the radiating elements having a pair of conductive patches, each one of the patches being disposed on opposite edges of the transmission line, each of the patches having a rhomboidal shape with edges disposed at an oblique angle with respect to the microstrip transmission line, the edges of one of the patches being at substantially ninety degrees to the edges of the other one of the patches, the patches being staggered with respect to each other along the transmission line by substantially a quarter-wave length at the nominal operating wavelength of the antenna element.

14 Claims, 4 Drawing Sheets

IN-LINE CP PATCH RADIATOR

BACKGROUND OF THE INVENTION

This invention relates generally to radio frequency antennas and more particularly to radio frequency antenna elements used therein.

As is known in the art, radio frequency antennas have a wide range of applications. In one type of antenna, a beam of radiation thereof is directed along a desired direction by physically positioning the boresight axis along the desired direction. In another type of antenna, a beam forming network is coupled to an array of antenna elements and the beam forming network provides a relative phase shift across the array of antenna elements to produce a radiation pattern in the desired direction. One type of beam forming network may include an input/output port coupled to the array of antenna elements through a network of controllable phase shifters. In another type, the beam forming network includes a plurality of input/output ports, each one thereof being associated with a differently directed beam of radiation. One of this latter type of beam forming network includes a Rotman/Turner microwave lens and is described U.S. Pat. No. 3,761,936. Multi-Beam Array Antenna", inventors D. H. Archer et al., issued Sep. 25, 1973, assigned to the same assignee as the present invention.

While such antennas are useful in many applications, in other applications it is necessary that the antenna be compact and inexpensive.

As is also known in the art, in many applications the array of antenna elements include a series of patch type radiating elements. One example of an array of patch radiating elements is described in U.S. Pat. No. 4,686,535 "Microstrip Antenna System with Fixed Beam Steering For Rotating Projectile Radar System", inventor Lalazari, issued Aug. 11, 1987. The type of patch radiating element described in such U.S. Pat. No. 4,686,535 is a terminating resonant patch radiator. The common concept of the patch radiator is that the radiation mechanism is an interruption of the radio frequency (RF) current by an abrupt discontinuity in the RF current. These discontinuities are considered by some to be elements in a resonant structure in which the patch is a resonant termination of the feed line or in a series resonant structure. While such patch radiators provide linear polarization, in some applications it is necessary that the antenna provide circular polarization.

SUMMARY OF THE INVENTION

In accordance with the present invention, an antenna element is provided having: a microstrip transmission line having a series of conductive patches, such patches having edges disposed at an oblique angle with respect to the microstrip transmission line.

In accordance with one feature of the invention, the transmission line has a second series of conductive patches. The second series of patches have edges disposed at an oblique angle with respect to the microstrip transmission line. The edges of the first mentioned series of patches are disposed at substantially ninety degrees with respect to the edges of the second series of patches. The patches in the first series are staggered with respect to the paths in the second series along the transmission line by substantially a quarter-wave length at the nominal operating wavelength of the transmission line.

With such arrangement the antenna element is configured to provide circularly polarized radiation.

In accordance with another feature of the invention, an antenna element is provided having a pair of microstrip transmission lines. A first one of the lines has a series of conductive patches, such patches having edges disposed at an oblique angle with respect to the microstrip transmission line. The second microstrip transmission line has a series conductive patches, such patches having edges disposed at an oblique angle with respect to the second microstrip transmission line. The edges of the first series of patches of the first transmission line are disposed at substantially ninety degrees with respect to the edges of the series of patches of the second transmission line. The first transmission line and the second transmission line extend parallel to each other. The edges of the patches of the first transmission line and the edges of the second transmission line intersect at a point between the pair of transmission lines. A power divider/combiner is provided having a pair of output/input ports and an input/output port. A signal fed to the input/output port appears in phase quadrature between the pair of output/input ports. The pair of output/input ports are coupled to the pair of transmission lines.

DESCRIPTION OF THE PREFERRED EMBODIMENTS

Figure 1B:
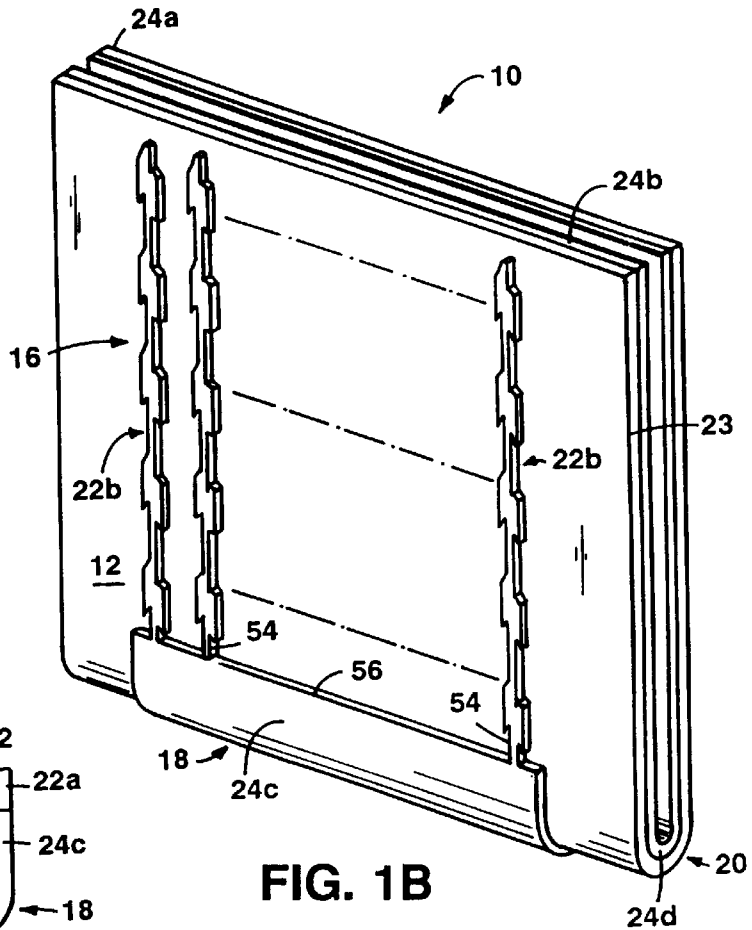
FIG. 1B is a isometric sketch of the antenna of FIG. 1A from a front perspective of such antenna.
Figure 1C:
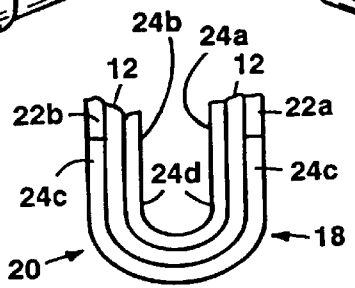
FIG. 1C is an exploded view of a folded portion of the antenna of FIGS. 1A and 1B, such portion being enclosed by dotted line 1C in FIG. 1A.
Figure 1A:
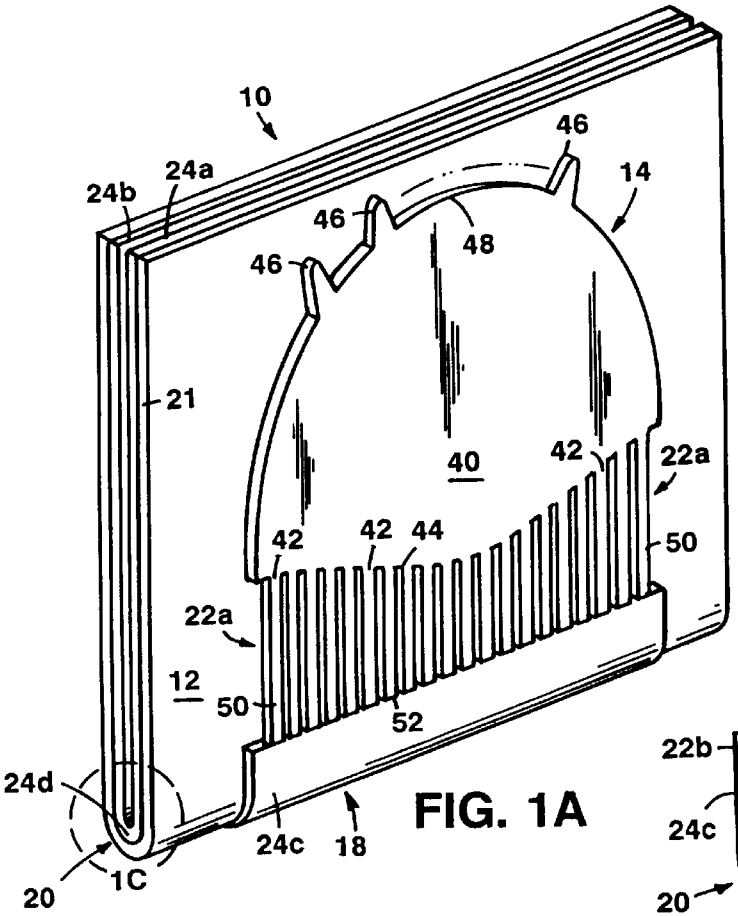
FIG. 1A is a isometric sketch from a rear perspective of an antenna according to the invention.

Referring now to FIGS. 1A and 1B, an antenna 10 is shown having: a beam forming network 14; an array of antenna elements 16; and a parallel plate region 18 coupling the array of antenna elements 16 and the beam forming network 14, all formed on a common, folded dielectric substrate 12. The beam forming network 14 includes strip conductor circuitry 22*a* separated from a ground plane conductor 24*a* by a rear portion 21 of the substrate 12. The array of antenna elements 16 includes strip conductor circuitry 22*b* separated from a ground plane conductor 24*b* by a front portion 23 of the substrate 12. The parallel plate region 18 is disposed about a folded region 20 of the substrate 12 and includes a pair of conductive plates 24*c*, 24*d* (FIG. 1C) separated by the folded region of the substrate 12. Here, the dielectric substrate 12 is U-shaped with the ground plane conductors 24*a*, 24*b*, 24*d* being a single conductive sheet clad to the inner surface of the U-shaped substrate 12. The strip conductor circuitry 22*a*, 22*b* and plate 24*c* are etched into a conductor clad onto the outer surface of the U-shaped substrate 12. Thus, the portion 24*d* of the ground plane conductor 24 disposed about the inner portion of the folded region of substrate 12 provides one of the two parallel plates of the parallel plate region 18. Conductor 24*c* provides the other one of the plates for the parallel plate region 18. The strip conductor circuitry 22*a* of the beam forming network 14 and the strip conductor circuitry 22*b* of antenna elements 16, the ground plane conductor 24 thereof and the conductive plate 24*c* of the parallel plate region 18 are formed using conventional printed circuit, photolithographic chemical etching processes.

Here, the beam forming network 16 is a microwave lens having a lens element 40 printed on the outer surface of substrate 12. A plurality of array ports 42 is disposed along one edge 44 thereof and a plurality of beam ports 46 are disposed along an opposite edge 48 of the lens element 40. Each one of the beam ports 46 is associated with a differently directed one of a plurality of beams. The electrical lengths between each point on a wavefront of such beam, through the array of antenna elements, the parallel plate region and the microwave lens to the one of the beam ports associated therewith, being electrically equal to each other.

The beam forming network 14 includes a plurality of microstrip transmission lines 50 coupling the array ports 42 to one end 52 of the parallel plate region 18. The array of antenna elements 16 includes a plurality of microstrip transmission lines 54 coupled to an opposite end 56 of the parallel plate region 18. The ground plane conductors 24*a*, 24*b* of the beam forming network 14 and the array of antenna elements 16 comprise a single conductor, here ground plane conductor 24. The ground plane conductor 24 is disposed on the inner surface of the U-shaped substrate 12. The strip conductor circuitry 22 of the antenna elements 16 and the beam forming network 14 are disposed on the outer surface of the U-shaped substrate 12, as described above.

Figure 2:
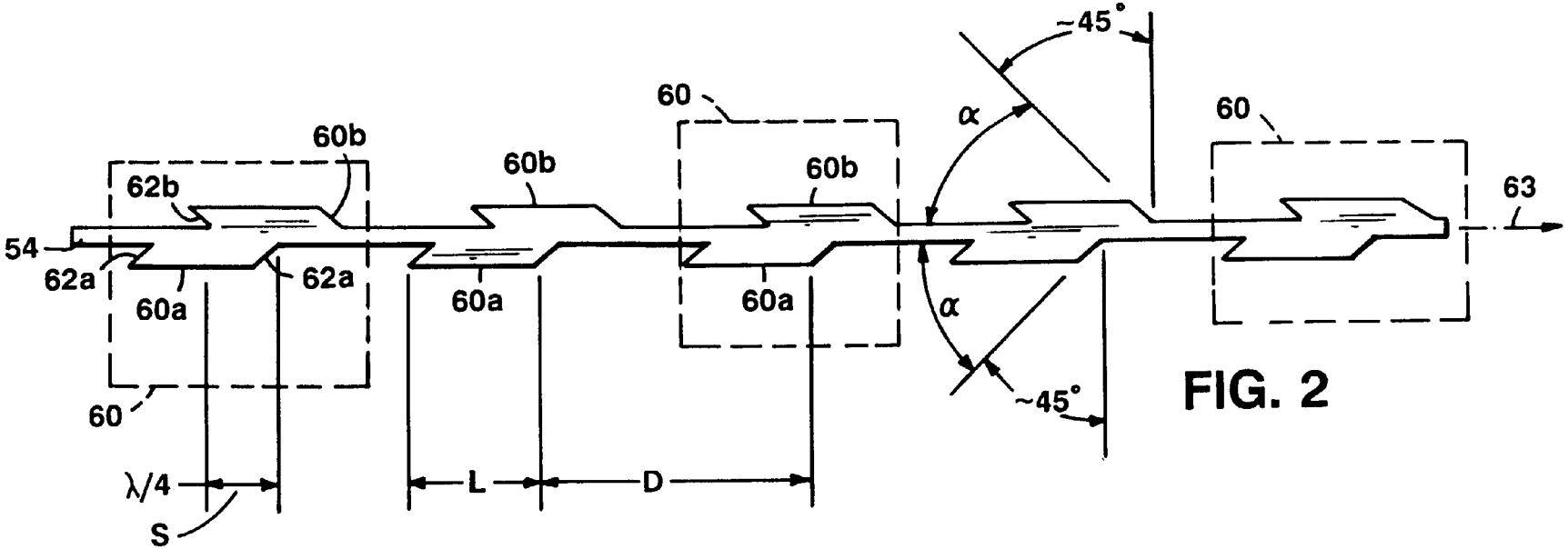
FIG. 2 is a plan view of strip conductor circuitry forming one element of an array of antenna elements according to the invention and adapted for use in the antenna of FIGS. 1A and 1B.

The antenna elements 16 are of the same configuration. The strip conductor circuitry 22 of an exemplary one thereof is shown in FIG. 2. Thus, the antenna element includes a microstrip transmission line having two series of conductive patches 60*a*, 60*b*, respectively. Here each patch is rhomboidal shaped. More particularly, the patches 60*a* have edges disposed at an oblique angle, $\alpha$, here substantially forty-five degrees, with respect to the microstrip transmission line and patches 60*b* have edges disposed at an oblique angle, $-\alpha$, here substantially negative forty-five degrees. Thus, the edges of one of the patches 60*a* are at substantially ninety degrees to the edges of the other one of the patches 60*b*.

Thus, as shown in FIG. 2, each patch radiating element 60 is made up of a microstrip transmission line 54 having a series of pairs of contiguous patches 60*a*, 60*b*, (i.e., each one of the radiating elements has a pair of conductive patches). Each one of the patches is disposed on opposite edges of the transmission line. Each of the patches has edges disposed at an oblique angle, here substantially +/− forty-five degrees, with respect to the microstrip transmission line. Further, one patch in each patch radiating element is staggered with respect to the other patch in the radiating element along the transmission line by substantially a quarter-wave length at the nominal operating wavelength of the transmission line. That is the center-to-center spacing, S, between the pair of staggered patch elements 60*a*, 60*b* making up a patch radiating element 60 are separated by $\lambda/4$, where $\lambda$ is the nominal operating wavelength of the antenna element. As shown, the distance S, that is approximately $\lambda/4$, is also the approximate distance from the center to one end of patch 60*a*, and thus the length L of the patches 60*a* is approximately $\lambda/2$ at the nominal operating wavelength of the transmission line.

It should be noted that patches 60*a* may be conventional rectangular patches. Here, however, the patches are rhomboidal shaped to produce a circular polarized beam of radiation. More particularly, and referring first to FIG. 3, a series of rhomboidal shaped patches 60' and a transmission line 54' therefor, are shown. At a series discontinuity, the electric field is normal to the underlying ground plane conductor, not shown, and such electric field is also normal to the conductive edge of the patch. Thus, here because the edges 62' of each one of the patches are skewed, here by $\alpha$, with respect to the direction 63 of the transmission line 54', in spatial directions normal to the plane of the antenna the far electric field produced by the abrupt, tilted (by $\alpha$) discontinuity will be polarized in a plane which is nearly perpendicular to the radiation edge. Therefore, a slant (by $\alpha$) polarization is achieved. It should be noted that the tilt of the electric field relative to the plane containing the array axis will generally be less than the tilt of the edge discontinuity due to the mutual coupling between adjacent ones of the patches.

Figure 4:
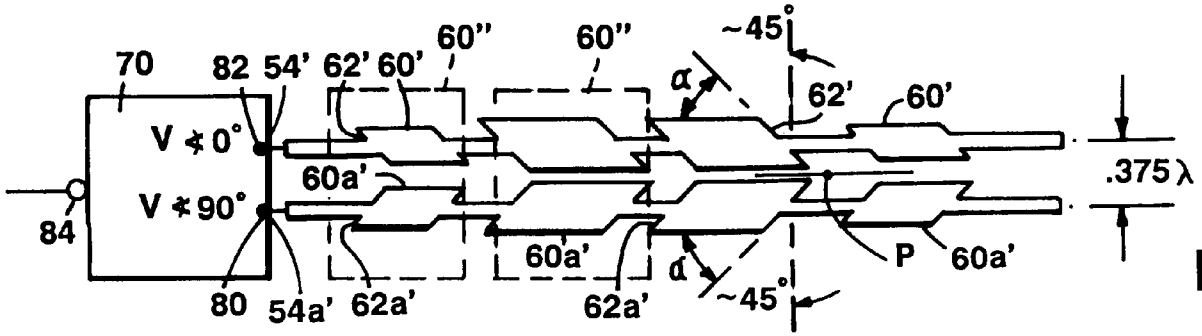
FIG. 4 is a plan view of strip conductor circuitry forming one element of an array of antenna elements according to an another alternative embodiment of the invention and adapted for use in the antenna of FIGS. 1A and 1B according to the invention.

For an electrically large antenna aperture, the width 100 of the patch 60' will typically be less than two widths 102 of the interconnecting high impedance transmission line 54'. Thus, as shown in FIG. 4, a pair of side-by-side radiators 60" which produce orthognal linear polarizations, when coupled to a ninety degree phase combiner/divider 70 is able to provide a circular polarized radiation pattern. The second microstrip transmission line 54*a'* has a series conductive patches 60*a'*, such patches 60*a'* having edges 62*a'* disposed at an oblique angle, here +/± forty-five degrees with respect to the edges 62' of the patches 60'. The edges 62' of the patches 60' are disposed at substantially ninety degrees with respect to the edges 62*a'* of the second series of patches 60*a'*. The transmission line 54' and the second transmission line 54*a'* extend parallel to each other. The edges 62' and the second edges 62*a'* extend along lines which intersect at a point, P, between the transmission line 54' and the second transmission line 54*a'*. The power divider/combiner 70 has a pair of output/input ports 80, 82 and an input/output port 84. A signal fed to the input/output port 84 appearing in phase quadrature between the pair of output/input ports 80, 82, and visa versa under principles of reciprocity. The pair of output/input ports 80, 82 are coupled to transmission line 54' and the second transmission line 54*a'*, respectively, as shown.

Thus, referring again to FIG. 2, the patches 60*a* are not disposed about the longitudinal axis of the transmission line 54 but rather are entirely to one side of the transmission line, as shown. With the radiation formed to one side of the transmission line 54, a second discontinuity with orthognal polarization can be placed on the other side of the transmission line 54 by patches 60*b*, as shown in FIG. 2. Here, the second patches 60*b* are displaced, S, along the transmission line 54 by $\lambda/4$ (where $\lambda$ is the nominal operating wavelength of the antenna element) along the longitudinal axis of the transmission line 54, as noted above. Each pair of patches 60*a*, 60*b* thus form a series fed, circularly polarized radiator patches 60. The coupling to the radiation field is controlled by the width of the patches 60*a*, 60*b*, and phase control is achieved by controlling the patch spacing.

Figure 3:
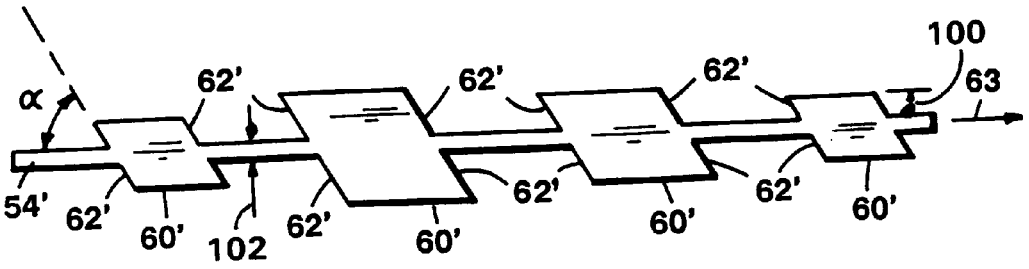
FIG. 3 is a plan view of strip conductor circuitry forming one element of an array of antenna elements according to an alternative embodiment of the invention and adapted for use in the antenna of FIGS. 1A and 1B.

Thus, in FIGS. 2, 3 and 4, the patches 60*a*, 60*b*, 60', 60*a'* are rhomboidal conductive patches disposed serially along, and integrally formed with, the strip transmission line 54,

54', 54*a*', as shown. The patches are formed on a surface of the solid material as a single layer of conductive material.

Figure 5:
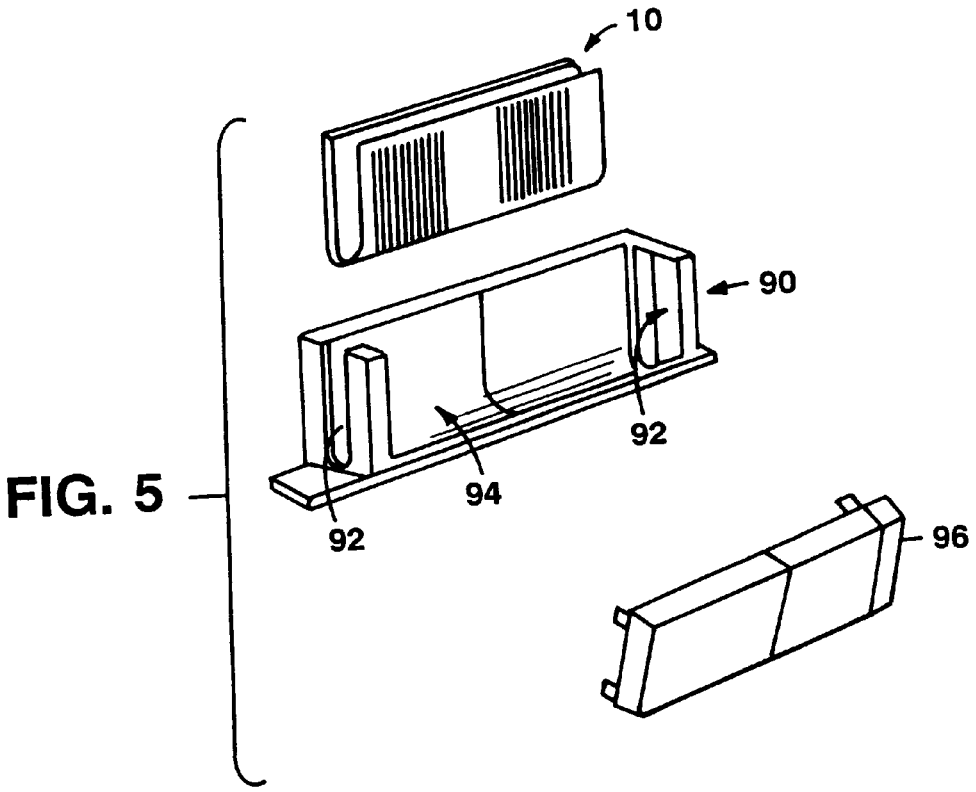
FIG. 5 is an exploded, isometric sketch of the antenna of FIGS. 1A and 1B together with a housing and radome for such antenna.

Referring now to FIG. 5, a package 90 for the antenna 10 (FIGS. 1A, 1B). Package 90 has a slot 92 for receiving the U-shaped antenna 10. The front portion 94 of the package 90 is open and adapted for a snap-on radome 96. The radome 96 faces the front portion of the antenna 10, i.e., the array of antenna elements 16 (FIGS. 1A, 1B).

Figure 6B:
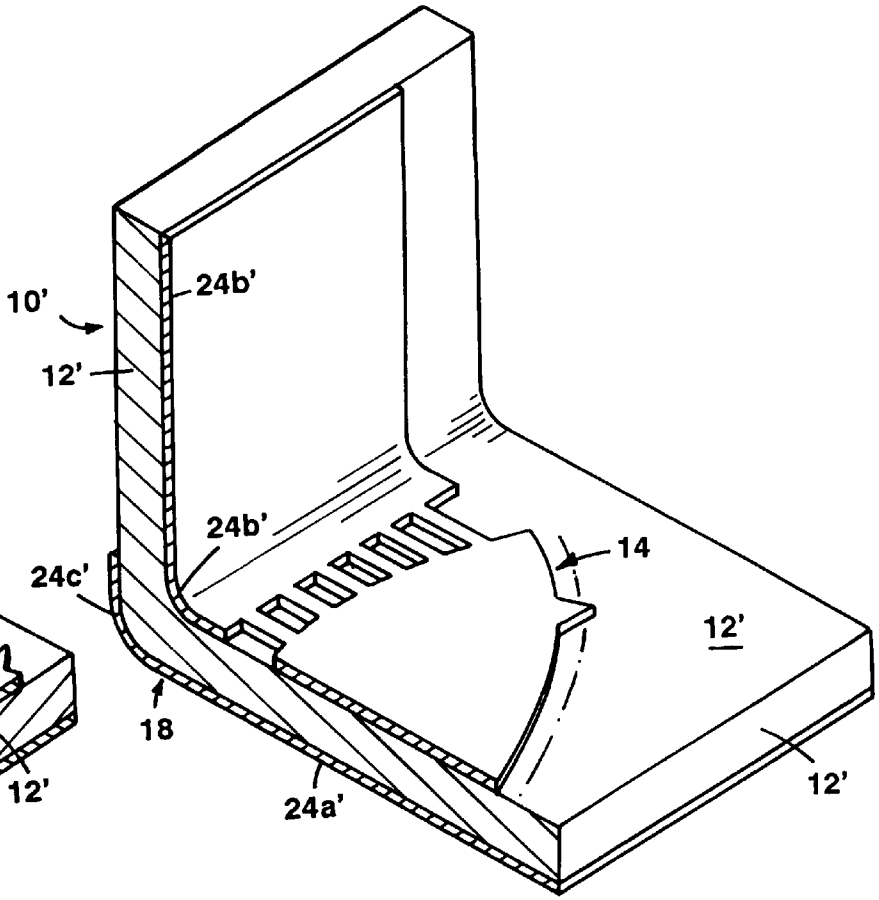
FIG. 6B is a isometric, cross-sectional sketch of the antenna of FIG. 6A from a front perspective of such antenna.
Figure 6A:
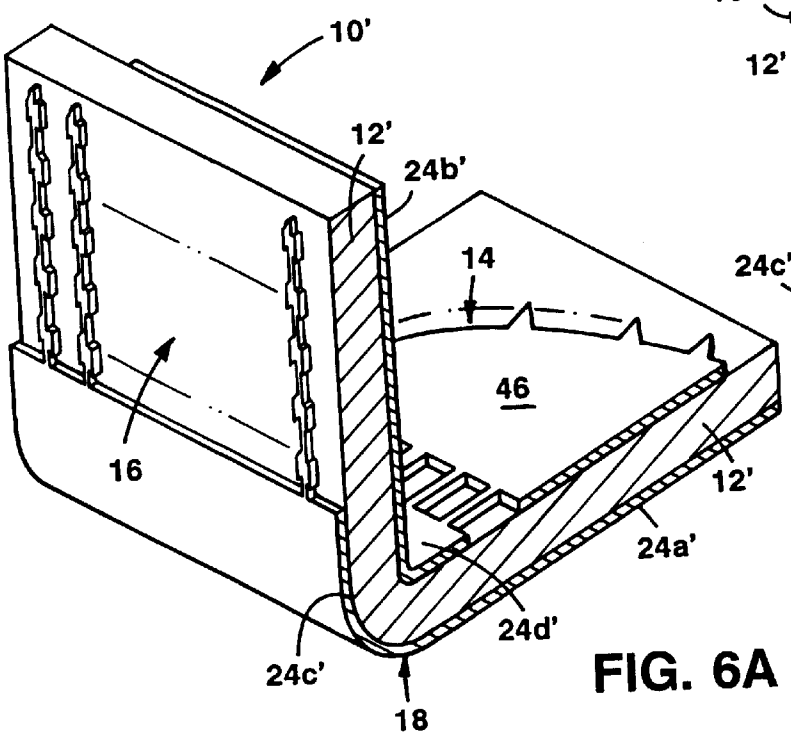
FIG. 6A is a isometric, cross-sectional sketch from a rear perspective of an antenna according to an alternative embodiment of the invention.

Referring now to FIGS. 6A, 6B, an L-shaped dielectric substrate is provided for the antenna 10'. Thus, here again, the antenna 10' includes: a beam forming network 14; an array of antenna elements 16; and a parallel plate region 18 coupling the array of antenna elements 16 and the beam forming network 14, all formed on a common, folded dielectric substrate 12'. Here, however, the substrate 12' is, as noted above, L-shaped. The beam forming network 14 is again a microwave lens 40 as described above in connection with FIGS. 1A and 1B. The ground plane conductor 24*a*' of the beam forming network 14 and the ground plane conductor 24*b*' of the array of antenna elements 16 are disposed on opposite surfaces of the L-shaped substrate 12' and the strip conductor circuitry of the array of antenna elements 16 and the beam forming network are disposed on the opposite surfaces of the L-shaped substrate 12'. One portion of ground plane conductor 24*b*' provides one plate 24*c*' of the parallel plate region 18 and one portion of ground plane conductor 24*a*' provides the other plate for the parallel plate region 18.

It should be noted that in both antenna 10 (FIGS. 1A, 1B) and antenna 10" (FIG. 6A, 6B), a ground plane conductor is disposed between the feed network and the array of antenna elements.

What is claimed is:

1. An antenna element, comprising;

a microstrip transmission line having a series of conductive patch radiating elements, each one of the radiating elements having a pair of conductive patches, each one of the patches being disposed on opposite edges of the transmission line, each of the patches having a rhomboidal shape with edges disposed at an oblique angle with respect to the microstrip transmission line and displaced from each other by a multiple of about half of a nominal operating wavelength of the antenna element, the edges of one of the patches being substantially ninety degrees to the edges of the other one of the patches, the patches in each pair being staggered with respect to each other along the transmission line by substantially a quarter wavelength at the nominal operating wavelength of the antenna element.

2. The antenna element recited in claim 1 wherein the multiple is one.

3. The antenna element recited in claim 1 wherein each of the patches further includes a second edge displaced from, and parallel to, the transmission line that loins the first-mentioned edges of the patches.

4. The antenna element recited in claim 3 wherein the second edge is displaced from the transmission line a distance less than about twice the width of the transmission line.

5. The antenna element recited in claim 1 wherein the edges disposed at an oblique angle with respect to the microstrip transmission line are displaced from each other such that these edges are primary radiating edges of the antenna element.

6. The antenna element recited in claim 1 wherein the edges are disposed at an angle, measured from the edges to a direction of travel of energy along the transmission line, substantially ninety degrees plus the oblique angle.

7. An antenna comprising;

a transmission line comprising;

a ground plane conductor;

a dielectric;

a strip conductor, such strip conductor being separated from the ground plane by the dielectric;

a plurality of first rhomboidal conductive patches disposed serially along, and integrally formed with, a first side of the strip conductor, first edges of the first patches intersecting the strip conductor at a first oblique angle and a second edge of the first patches connecting the first edges substantially parallel to the transmission line, each first patch being integral with the strip conductor a distance of a multiple of about half of a nominal operating wavelength of the antenna; and a plurality of second rhomboidal conductive patches disposed serially along, and integrally formed with, a second side, opposite the first side, of the strip conductor, first edges of the plurality of second patches intersecting the strip conductor at a second oblique angle substantially ninety degrees relative to the first oblique angle and second edges of the second patches connecting the first edges of the second patches substantially parallel to the transmission line, each second patch being integral with the strip conductor a distance of a multiple of about half of a nominal operating wavelength of the antenna;

wherein each one of the first patches is staggered about a quarter wavelength at the nominal operating wavelength of the antenna from a corresponding one of the second patches.

8. The antenna recited in claim 7 wherein the first and second oblique angles are substantially forty-five degrees.

9. The antenna recited in claim 8 wherein the dielectric is a solid material and wherein the strip conductor and the first and second patches are formed on a surface of the solid material as a single layer of conductive material.

10. The antenna recited in claim 8 wherein the first and second oblique angles are measured from the edge toward a direction opposite a direction of travel of energy along the strip conductor.

11. The antenna recited in claim 7 wherein the multiple is one.

12. An antenna comprising:

a conductive ground plane;

a dielectric disposed over the ground plane;

an elongated conductor displaced a distance from the ground plane by the dielectric; and a plurality of radiating conductors each including first and second edges extending from the elongated conductor at oblique angles and displaced from each other such that energy applied to the plurality of radiating conductors will radiate primarily from the first and second edges thereof;

wherein pairs of the plurality of radiating conductors are disposed on opposite sides of the elongated conductor and are displaced along the elongated conductor relative to each other by approximately a quarter of a nominal operating wavelength of the antenna.

13. The antenna recited in claim 12 wherein the plurality of radiating conductors each include a third edge substantially parallel to a length of the elongated conductor joining the first and second edges and displaced from the elongated conductor a distance less than about twice the width of the elongated conductor.

14. The antenna recited in claim 12 wherein the first and second edges are separated by approximately one half of a nominal operating wavelength of the antenna.

* * * * *